United States Patent [19]

Heather

[11] Patent Number: 4,905,437

[45] Date of Patent: Mar. 6, 1990

[54] FLOORING SYSTEM AND METHOD OF PROVIDING

[75] Inventor: John Heather, Stirling, Australia

[73] Assignee: Cablefloor (Australia) Pty. Ltd., Dulwich, Australia

[21] Appl. No.: 241,955

[22] Filed: Sep. 8, 1988

Related U.S. Application Data

[63] Continuation-in-part of Ser. No. 97,965, Jul. 22, 1987, abandoned.

[30] Foreign Application Priority Data

Apr. 21, 1988 [AU] Australia ..... PI7843

[51] Int. Cl.[4] ..... E04F 15/024

[52] U.S. Cl. ..... 52/263; 52/221; 52/480; 52/747

[58] Field of Search ..... 52/221, 126.6, 263, 52/408, 741, 220, 480, 747

[56] References Cited

U.S. PATENT DOCUMENTS

| | | | |
|---|---|---|---|
| 3,157,254 | 11/1964 | Spiselman | 52/126.6 |
| 4,438,610 | 3/1984 | Fifer | 52/126.6 |
| 4,546,580 | 10/1985 | Ueno | 52/408 |
| 4,593,499 | 6/1986 | Kobayashi | 52/126.6 |
| 4,736,555 | 4/1988 | Nagare | 52/263 |

FOREIGN PATENT DOCUMENTS

| | | | |
|---|---|---|---|
| 3413446 | 10/1985 | Fed. Rep. of Germany | 52/126.6 |

*Primary Examiner*—John E. Murtagh

*Attorney, Agent, or Firm*—Cushman, Darby & Cushman

[57] ABSTRACT

A flooring system and a module for a flooring system made of a series of floor support modules each of which has a number of props in a grid matrix and joined together by an integral frame. Attachment means is provided to join the units to adjacent units and clamping plates are used to provide a positive location of a floor panel on the module. Services such as electricity, telephone and computer cables may be laid in the cavities or voids under the floor panel.

17 Claims, 7 Drawing Sheets

FLOORING SYSTEM AND METHOD OF PROVIDING

Reference to Related Application

This is a continuation in part of Ramsey et al, Ser. No. 07/097,965, filed Jul. 22, 1987 (now abandoned).

BACKGROUND OF THE INVENTION

This invention relates to flooring systems and more particularly to false or access floor systems suitable for the installation of services thereunder or therein.

There exists a problem in the installation, in offices and similar work areas, of services such as electricity, telephone, computer wiring, water, gas and refrigeration systems for machines such as computers and particularly the provision of these services into spaces such as open plan offices, shops with island-type displays, factories, laboratories, classrooms, exhibition stands and similar environments. The problem of installation is further exacerbated in open space areas when there is no prior knowledge of the tenants or users requirements at the time of building construction.

There are known systems to provide services around the periphery of such an area, but where such a service is required within the area, then, the flooring must have ducts pre-laid or outlets must be suspended from a ceiling void or roof to provide services to such points. Floor ducts cannot be moved once they are installed and are often spaced at too great an interval to provide a flexible solution to the problem. The supply of services from the ceiling is usually unsightly.

There are access floor systems for power stations and main frame computer installations, but these access floor systems comprise substantial and tall pedestals to the corners of panels with possibly stringers between the pedestals, and thick, heavy access floor panels. Such systems are not suitable for economic installation within large office spaces, plus their considerable installed weight creates an added load on a building's structure. Quite often, the minimum finished floor height of these systems also prohibits their installation when the existing available floor to ceiling height is already close to the minimum required by an applicable standard.

Australian patent specification No. 458973 entitled MODULAR FLOORING, shows a floor module to mount on an existing floor. This includes a floor panel with supports underneath fixed to the underside of the panel. The supports are designed to be affixed onto the sub-floor and hence access to the under floor region can only be obtained around the edges of the region covered by this type of modular flooring and hence it is very difficult to install new services once this flooring has been fastened in place.

U.S. Pat. No. 3943673 entitled ELEVATED FLOOR ASSEMBLY defines a series of large panels on pedestals with interlocking means between the panels. Each of the pedestals has means for providing individual height adjustment which, although a level floor can be obtained thereby, a time-consuming process is necessary to ensure that each pedestal is adjusted separately. This type of arrangement is particularly adapted for main frame computer installations but is not suitable for general office environments.

Australian patent specification No. 484603, corresponding to U.S. Pat. No. 4573299, entitled FLOOR COVERING ARTICLE, provides a matrix base for a false floor which includes a plate-like upper surface integral with the base elements. This article requires that services first be laid down on the sub-floor surface and then the upper surface with the integral base elements laid down to provide a false floor. Some difficulty occurs in positioning the services so that they do not interfere with the base elements and, in fact, these systems are particularly difficult to use.

Some unique problems exist with the installation of false floor arrangements for electricity and telephone services and obtaining permission from the relevant authorities to install these services within a low-in height, false floor system. An arrangement having an upper surface permanently fixed to legs or posts, which are in turn fastened to the sub-floor to prevent movement, creates spaces or voids between and around the legs or posts. These may be classified as ducts or wiring enclosures and hence require special mechanical separation of the different types of services contained therein. However, if the floor surface including the carpet covering is easily removable, then, even if the support module is fastened to the floor, the false floor space or void may alternatively be classified as a building cavity. Hence, in Australia, for instance, it is only necessary in spaces classified as a building cavity that services be separated by 50 millimeters of air space along their runs and that at cross-over points there be provided at least 6 millimeters of insulating material overlapping the cross-over by 25 millimeters on all sides.

A further problem exists in that many sub-floors onto which access floors are to be installed are not even or level. Hence, provision of some form of leveling capability may be required. Prior art devices of the types that are discussed above rely on individual screw adjustment of each pedestal which can be a time-consuming operation.

SUMMARY OF THE INVENTION

It is an object of this invention to provide a floor-leveling methodology which is much simpler to apply during installation.

Existing access floor systems of the type discussed above also require that the installer carefully affixes each free-standing pedestal to the sub-floor (this is assuming stringers are not included) such that each pedestal is coincidental with the corners of the floor panels that rest upon them. This involves careful measuring and layout during installation. It is an object of the present invention to provide dimensional control the layout of the floor support system by way of a unitary construction of a consistent frame arrangement and post arrangement built into the design of the support system, thereby further lessoning the skill required to install an access floor.

Hence, it is the object of the present invention to provide a more versatile, cost-effective and lighter-weight access floor system which produces a building cavity rather than ducts in the false floor arrangement. It is the further object of the present invention to simplify and economize on the time required for installation, and, leveling and once in use, the effort required for initial and subsequent installation of services.

In one form, therefore, the invention provides module for a false floor support system, the module being of unitary construction and comprising a plurality of support props standing on end and of equal length, arranged perpendicular to and extending from a common plane and joined by an integral frame arrangement, connection means to enable the support module to be interconnected to at least one adjacent support module and at least one corner clamp receivable by means of a screw thread fastener to one of the support props, the corner clamp comprising a plate to hold down four adjoining floor panels to the floor support modules.

This plate on the corner clamp is designed to be rebated into the floor panels so that the top surface of a floor, once installed, is smooth, with the plate holding down the corners of four adjacent panels. The corner clamp may also include a plurality of webs extending down from the underside of the plate, which webs may, in use act as spacers between adjacent floor panels.

In turn, the false floor support modules may be adhered to the sub-floor to provide an overall rigid structure.

Each support prop may comprise a cylindrical body with radial webs extending from a central boss to the cylindrical body and the central boss may include an axial aperture to receive the screw, threaded fastener.

The connection means may comprise a prop interconnection pad including a planar plate and a plurality of engagement clips extending from the plate, the clips being adapted to engage the central boss of a support prop of an adjacent module.

In one preferred embodiment there may be further provided an attachment means on the frame arrangement to enable the positioning and retention of services, cabling and conduits.

The attachment means may for instance, comprise an extension from the frame attachment about which cable ties may be secured.

In one preferred embodiment, the support props may be arranged in a square pattern with an interconnecting frame comprising rigid arms extending between adjacent props, also laid out in a square grid arrangement. Alternatively, the grid arrangement may be based on a hexagonal or triangular basis.

The support props themselves may be cylindrical, but they could also be triangular, square, hexagonal or whatever shape is appropriate.

The rigid arms may extend from the base of each of the props and extending between the bases of the props such that the services, cabling and conduits may be laid in the voids formed over the interconnecting arms of the support modules, between adjacent props and under the floor panels.

The void so formed will be in the form of a series of channels defined by the props and, hence, facilitate the drawing of cables and the like through the void. These channels may conveniently be used for the reticulation of different services in an orderly fashion.

In a preferred arrangement of the false floor module according to this invention, the module may comprise a central prop with three further props arranged in a first square grid arrangement, the props being interconnected by a frame arrangement, three prop-interconnection pads with the three prop-interconnection pads and the central prop arranged in a second square grid arrangement having a grid spacing substantially the same as the grid spacing of the first grid arrangement, the first grid arrangement being on an opposite side of the central prop-from the second grid arrangement, the prop interconnection pads comprising the means to interconnect the module to adjacent modules and the three prop-interconnection pads joined to each other and to the central prop by a similar frame arrangement as in the first square grid.

There may be any other convenient number of props-and prop interconnection pads such as a matrix of nine props and five pads. The nine props would be arranged in a square matrix and the pads in a corresponding array about one corner of the array of props.

In this embodiment, the frame arrangement may comprise rigid arms extending between adjacent props-and prop interconnection pads and the corner clamp may be adapted to be received into any one of the props.

In an alternative form, the invention provides a false floor arrangement comprising a plurality of false floor support modules as defined above, each module being interconnected to adjacent modules by way of the interconnection pads and a plurality of floor panels on the upper surface of the props, with corner clamps securing the floor panels to the support modules.

By this means, it will be seen that there is provided a false floor support module which can be used as a series of interconnected modules on a floor, the floor panels laid over the false floor support modules, with the floor panels either being of a size to extend over two or more of the modules or a size to extend only over one module. Beneath the floor panels, there is defined a space or void, access to which may be obtained by lifting a floor panel.

In another form, the invention provides a method of installing a false floor comprising the steps of placing on the sub-floor a plurality of false floor support modules as discussed above, setting them out and simply joining or clicking them to adjacent floor support modules, applying adhesive under the base of at least every fourth prop in both directions, coincident with the corners of panels, locating panels loosely onto the false floor support module array, loosely fitting the corner clamps and screwing them down, without tightening, such that the corners of the next row of panels have an alignment device in the profile offered by the loose corner clamps, fitting the next row of panels, then tightening up the prior row of corner clamp screws, the process being repeated for further rows of panels.

It will be particularly noted that the adhesive used in accordance with this invention is not one which is thin in consistency, or which dries instantly, but one which is thick and stays workable during the installation of the panels, so that when the prior row of corner clamp screws is tightened as discussed above, the adhesive is then formed to an appropriate depth or thickness, depending on the levelness of the sub-floor in the current locality. This automatically occurs by the corner clamps pulling four adjoining floor panels down onto the support modules, or, more properly, pulling up the support modules, if necessary to the floor panels so that a substantially level and even final floor surface is obtained. For instance, where individual props of the support modules might have dropped into a shallow hollow in the sub-floor, these being lifted to align with the underside of the panel surfaces.

Subsequently, the adhesive under the props may cure into a hard mass, such that each individual or significantly effected prop is then supported at a level to give an overall firm, even and level upper support surface for the floor panels to rest upon.

For the purposes of this method it is preferable that the adhesive be of a flowing rubbery consistency whilst in an uncured form, so that it can be stretched or "sucked" to fill any gap between the sub-floor and the bottom of support props, but which, when it sets, becomes rigid enough to support the prop and any applied load from above.

The false floor support module according to this invention may be constructed from wood or metal or plastics material by any known manufacturing techniques. These may include injection moulding of thermosetting or thermoplastics material. Suitable fire retardant and other fillers, as desirable, may also be used. The module may alternatively be diecast from metals such as aluminium or zinc.

The floor panels above the support modules may be machined, press formed or moulded substantially from wood, wood particles, cellulose fibre-reinforced cement, glass fibre-reinforced cement, steel or plastics material or be steel frames or pans filled with concrete, lightweight concrete or magnesium cements. The panels may be provided with an existing grid of apertures for passing services through the panel from the underfloor cavity or they may be of such material that service entry/exit holes can be drilled at any desired location. The floor panels may be provided in a finished condition with a polished wood or vinyl or other suitable top surface or may have laid thereupon removable squares of carpet or some alternative floor covering material. The edges of the panels may be protected by a plastics edging and non-metallic panels may be encased in sheet steel or aluminium. There may be provided rebates at the corners of each of the panels to receive the corner clamps to the false floor support modules.

It may be desirable as discussed above to prevent movement of the false floor support modules when they are installed onto a sub-floor, hence, the bases of the props of the support modules may be provided with apertures to enable the receipt of fastening screws to fasten the support modules to a sub-floor or may be adhered as discussed above by any known adhesive suitable for the purpose. Each, or selected upper surfaces of the props may be provided with some form of shock-absorbent padding such as an elastomeric pad and such elastomeric pad may assist in damping any noise emanating from the false floor system caused by way of loose components moving against each other in final use. Also, these elastomeric pads may assist in eliminating any minor variations of level evident in the upper surface of the support props before the floor panels are installed.

It is to be noted that the props of the false floor support modules may be relatively short, perhaps in the order of 30 to 60 millimeters, but this is sufficient to provide space for the floor level reticulation of services such as electricity, telephone or computer wiring.

It will be realized that a false floor support module according to this invention may be made of any suitable dimensions and in one preferred embodiment a module may have a basic matrix dimension of 300 millimeters square. Thus, support props would occur at a grid interval of 150 millimeters once support modules were interconnected together. The diameter of cylindrical support props might be 70 millimeters, with an overall height of 38 millimeters. In this arrangement, the intervening cavity between support props for the reticulation of services would be 80 millimeters wide by 38 millimeters deep. The floor panels clamped to the top of these support props could be 450 or 600 millimeters square, or any other square or rectangular shape, provided that, once installed, their edges were coincident with the center line of support props. The floor panels could typically range from 15 to 33 millimeters thick, depending on the material employed in their construction. One preferred thickness for a particle board floor panel is 22 millimeters. When combined with the support module discussed above, this embodiment of the invention would result in an installed false floor with a finished floor height of 60 millimeters.

Alternatively, a module may have a basic size of 333 millimeters square. Thus, support props would occur at a grid interval of 166 millimeters, once support modules were interconnected together. The diameter of cylindrical support props might still be 70 millimeters with, in this instance, an overall height of 55 millimeters. In this arrangement, the intervening cavity between support props for the reticulation of services would be 96 millimeters wide by 55 millimeters deep. The floor panels clamped to the top of these support props could be 500 millimeters square. If a 25 millimeter thick press-formed fibre cement floor panel was employed in conjunction with the support module discussed above, the resultant finished floor height would be 80 millimeters.

A feature of this invention is that by having a plurality of props to support the under surface of each floor panel, rather than pedestals at the corners of panels, the thickness and strength of the floor panel can be reduced and economies made in component parts of the invention. In one embodiment discussed above, the unsupported distance between props is only 80 millimeters. Hence a wood particle board floor panel thickness of just 18 millimeters has proved to be quite acceptable, according to Australian Standards for dead and live loads in buildings.

There may be provided ramped floor segments to place around the periphery of the false floor region to raise an existing sub-floor to the height of the false floor, particularly at entrances and elevator doors and the like.

BRIEF DESCRIPTION OF THE DRAWINGS

This, then, generally describes the invention, but to more clearly assist with understanding of the invention, reference will now be made to the accompanying drawings which show preferred embodiments of the invention.

In the drawings.

DETAILED DESCRIPTION

Figure 1:
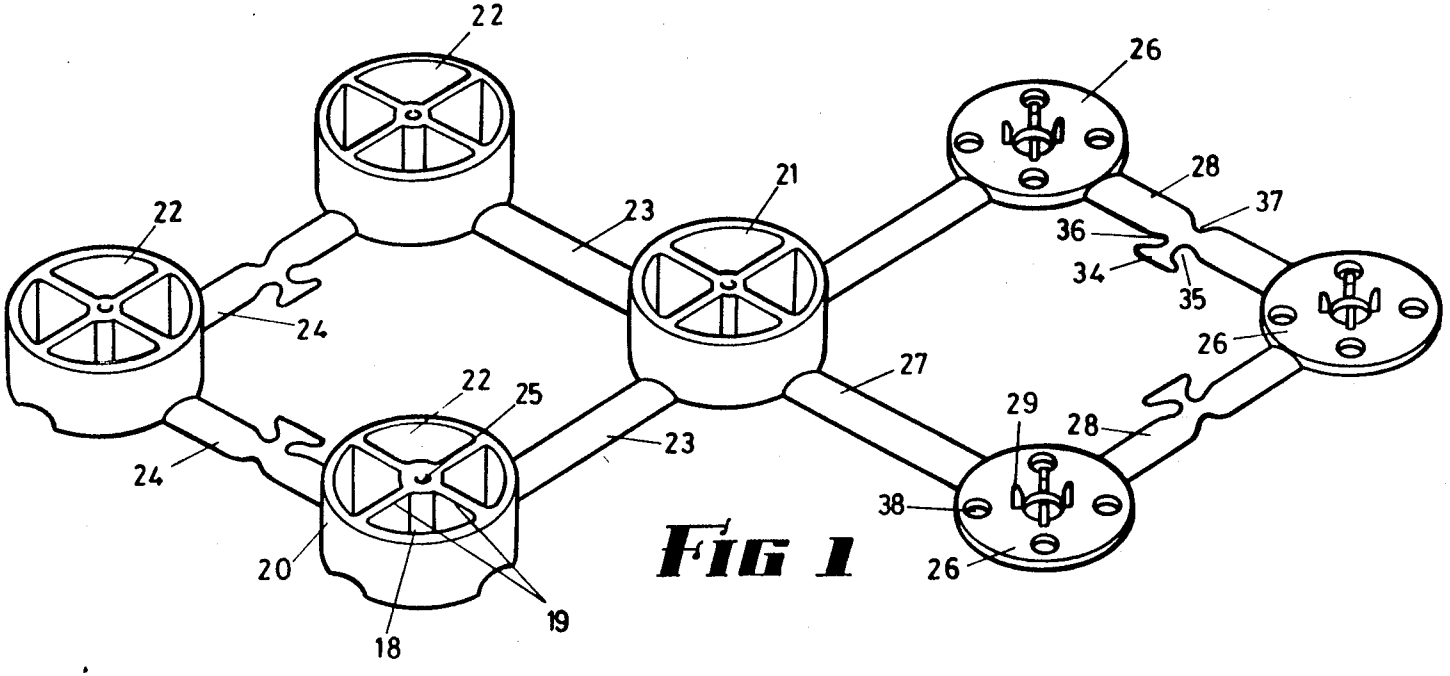
FIG. 1 shows an embodiment of the false floor support module according to this invention.
Figure 2:
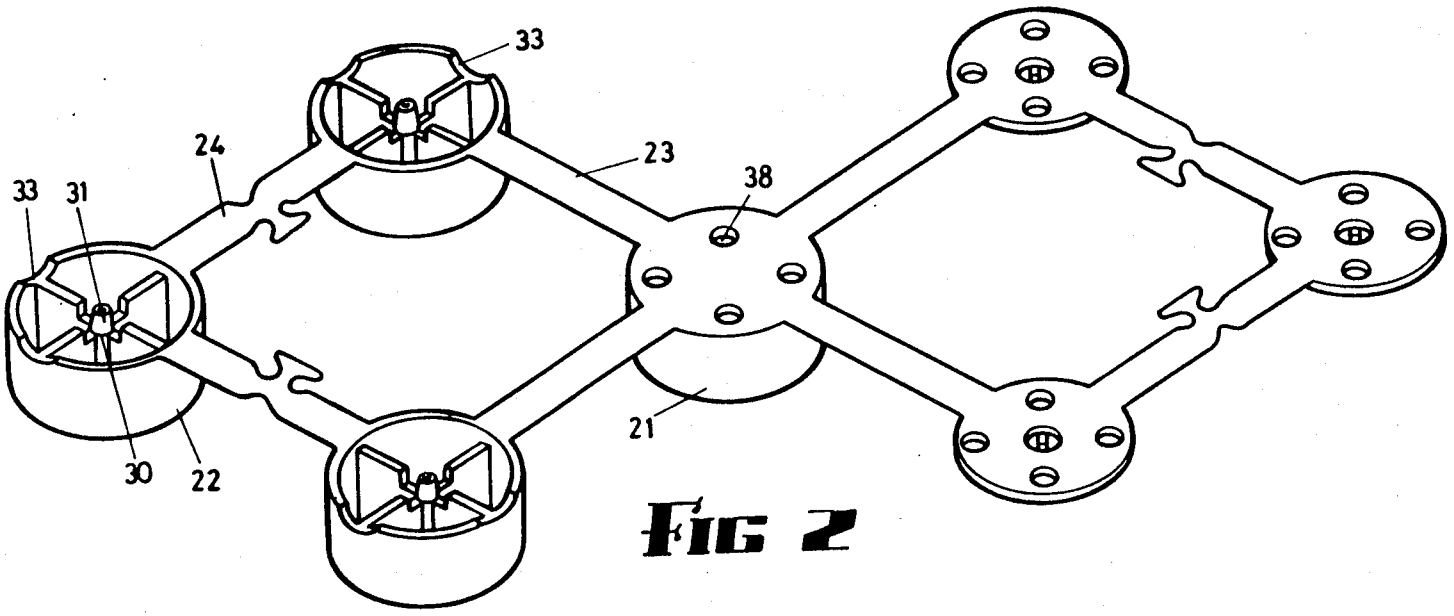
FIG. 2 shows an underneath view of the embodiment shown in FIG. 1.

A first embodiment, of the false floor support module is shown in FIGS. 1 and 2. In this embodiment a single false floor support module is of a unitary construction and includes a central prop 21 and three further props 22. Each prop 21 and 22 includes a cylindrical body portion 21 and radial webs 19 extending from the cylindrical body to a central boss 18. The central prop and the three further props 22 are held in a square grid arrangement by means of integral rigid arms 23 extending from the central prop 21 and integral rigid arms 24 around the periphery of the square grid arrangement. It will be noted that the arms 23 and 24 are semi-circular in cross-section, so that once the false floor support module is laid down and a floor panel placed over, cables being pushed or slid under the floor will not engage or be caught up on the arms. It will be noted that all of the props include an aperture 25 in the central boss 18 into which may be engaged a corner clamp for four adjoining floor panels when placed on the false floor support modules. There are further included three prop-interconnection pads 26 on further integral rigid arms 27 and 28 in a further square grid arrangement with the central prop 21, having the same square grid arrangement size as the first-mentioned in relation to the four props-but spaced on the other side of the central prop from the three further props 22.

The term unitary construction is used to describe a construction that is manufactured as a single piece, rather than being assembled from a number of individual pieces. This type of construction is of considerable advantage, as it keeps the price of individual modules to a minimum. In one preferred embodiment, the modules are injection moulded from plastics materials in a ready to use form.

The prop-interconnection pads 26 include a planar plate having extending therefrom four engagement clips 29. In use, the prop-engagement pads 26 fit within the further props 22 of the adjacent floor support modules, with the diameter of the prop interconnection pads being such as to just fit in the internal diameter of the further props 22, with the engagement clips 29 engaging over the rim 30 of boss 31 underneath the three further props 22 at the base of the central boss 18. It will be noted that the arms 28 fit into recesses 33 in the underside edges of the cylindrical bodies of the props 22.

It will be noted that on the frame arms 24 and 28 there are provided attachment means comprising an extension 34, extending from one side of the arm 28, for instance with recesses 35, 36 and 37 formed adjacent the extension 34. A cable tie to fasten cables to the framework may be passed under the extension 34 to extend out of the recesses 35, or, 36 or if a cable is to be laid diagonally, to extend either from the recess 35 or 36 to the recess 37.

It will be noted that apertures 38 are provided in the base of the prop-interconnection pads 26 and also in the base of the central prop 21. If the false floor support module is to be laid onto a wooden floor, then, suitable screw fastening means may be provided to fasten the false floor support modules to the floor. Alternatively, on any floor surface, adhesive may be placed underneath the pads 26 and, the central props 21 and when the module is placed onto the floor, adhesive may ooze through the apertures 38 to provide, when the adhesive has set, better mechanical as well as adhesive fastening.

Figures 3, 4:
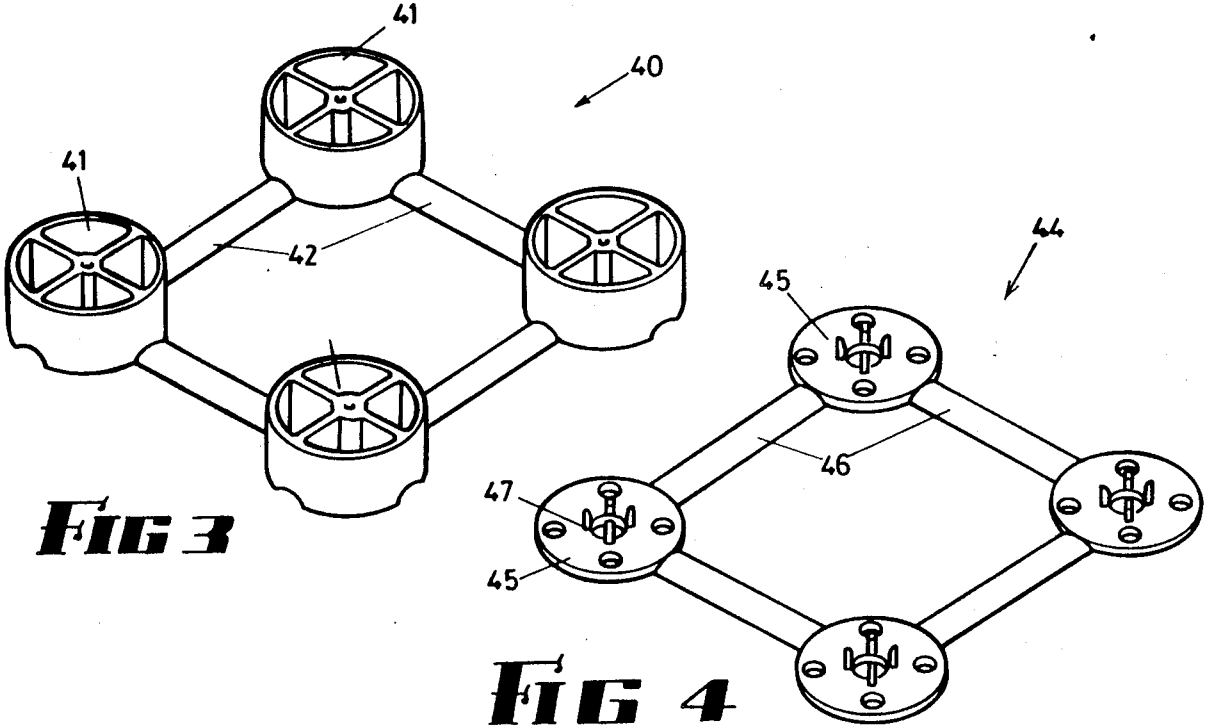
FIG. 3 shows a perspective view of an alternative embodiment of a false floor support module according to this invention.
FIG. 4 shows a connection module suitable for the false floor support module of FIG. 3.
Figure 6:
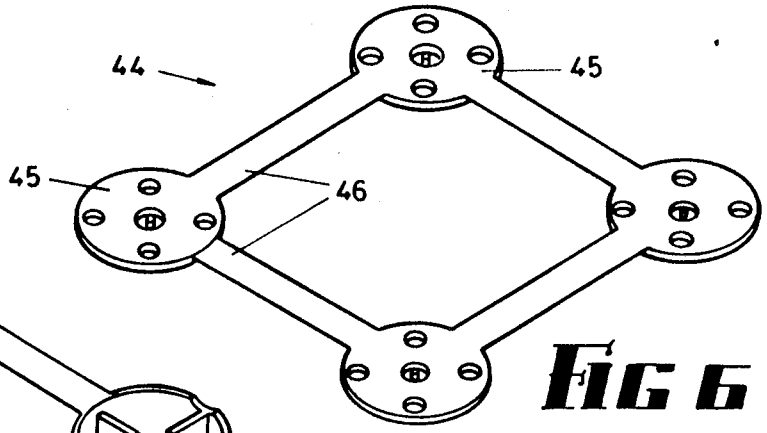
FIG. 6 shows an underneath view of the connection module as shown in FIG. 4.
Figure 5:
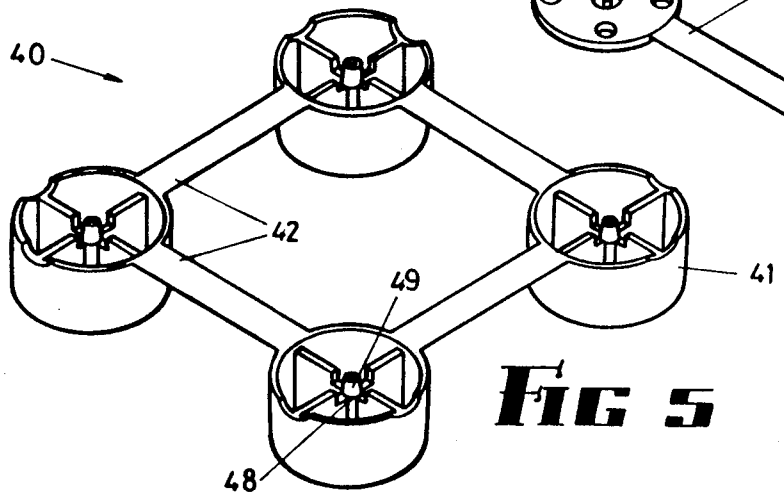
FIG. 5 shows an underneath view of the embodiment shown in FIG. 3.

FIGS. 3, 4, 5, and 6 show an alternative embodiment of the false floor support module according to this invention. In this embodiment, a first part of the module 40 as shown in FIG. 3 is of unitary construction and includes four props 41 spaced apart in a square grid arrangement by means of integral rigid arms 42, with all the props including an aperture 43 for engaging a screw threaded fastener to receive a corner clamp for fastening down four adjoining floor panels. The other part of the floor support module shown in FIG. 4 is also of unitary construction and comprises an interconnection module 44, comprising four interconnection pads 45 spaced apart by integral rigid arms 46. A similar connection arrangement, by the use of engagement clips 47 on the pads 45 engaging over the rim 48 of spigot 49 on the underneath of the props 41 to the embodiment shown in FIG. 5, is provided.

Figure 7:
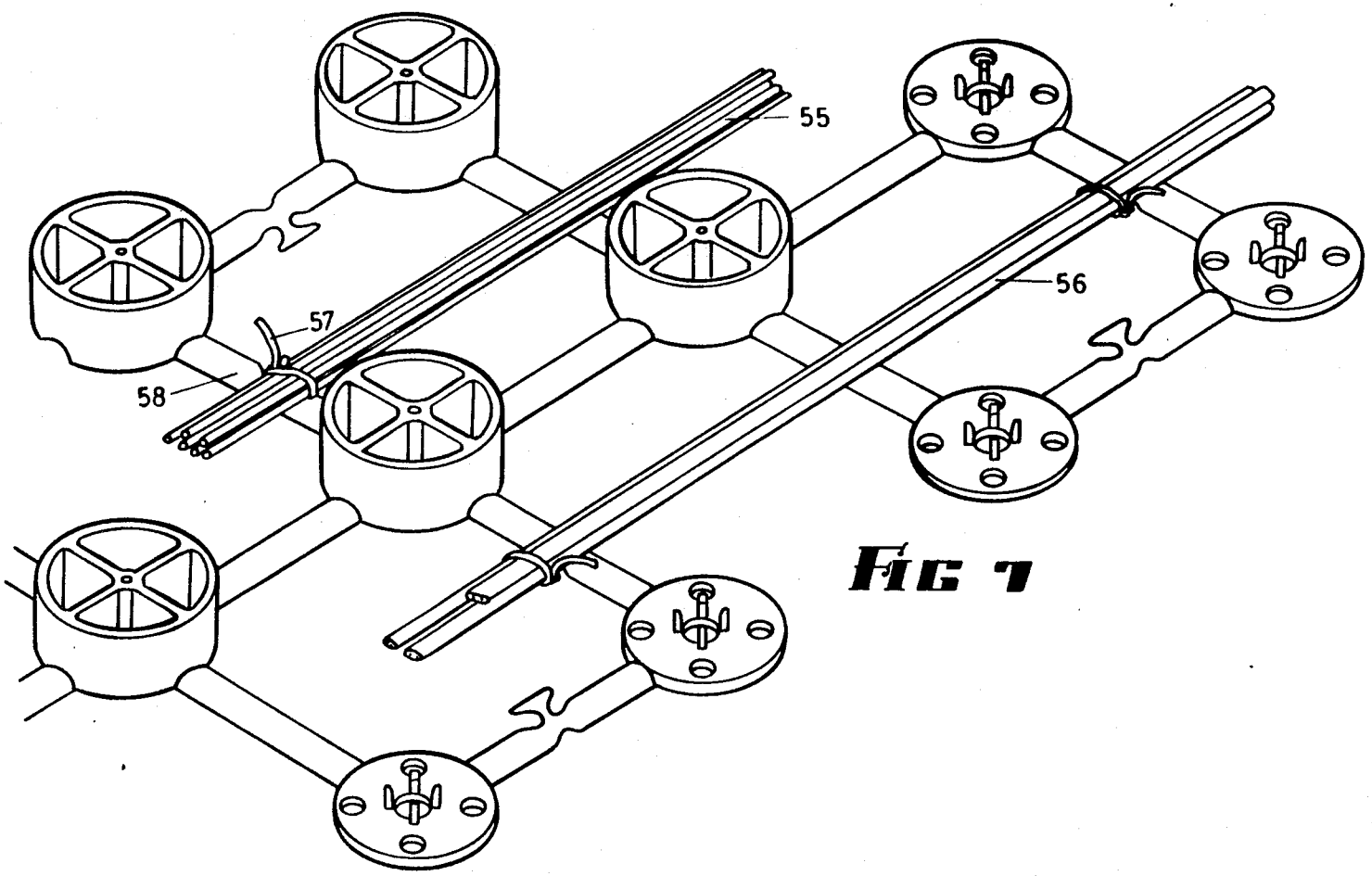
FIG. 7 shows a method of retaining services according to one embodiment of the invention.

FIG. 7 shows how cables 55 and 56 may be tied by means of ties 57 to the frame arms 58. It will be noted that, with the spacing of attachment means as shown in FIGS. 1 and 2, the cables may be fastened on alternate arms to provide good rigid fastening and to prevent cables from snaking.

Figure 8:
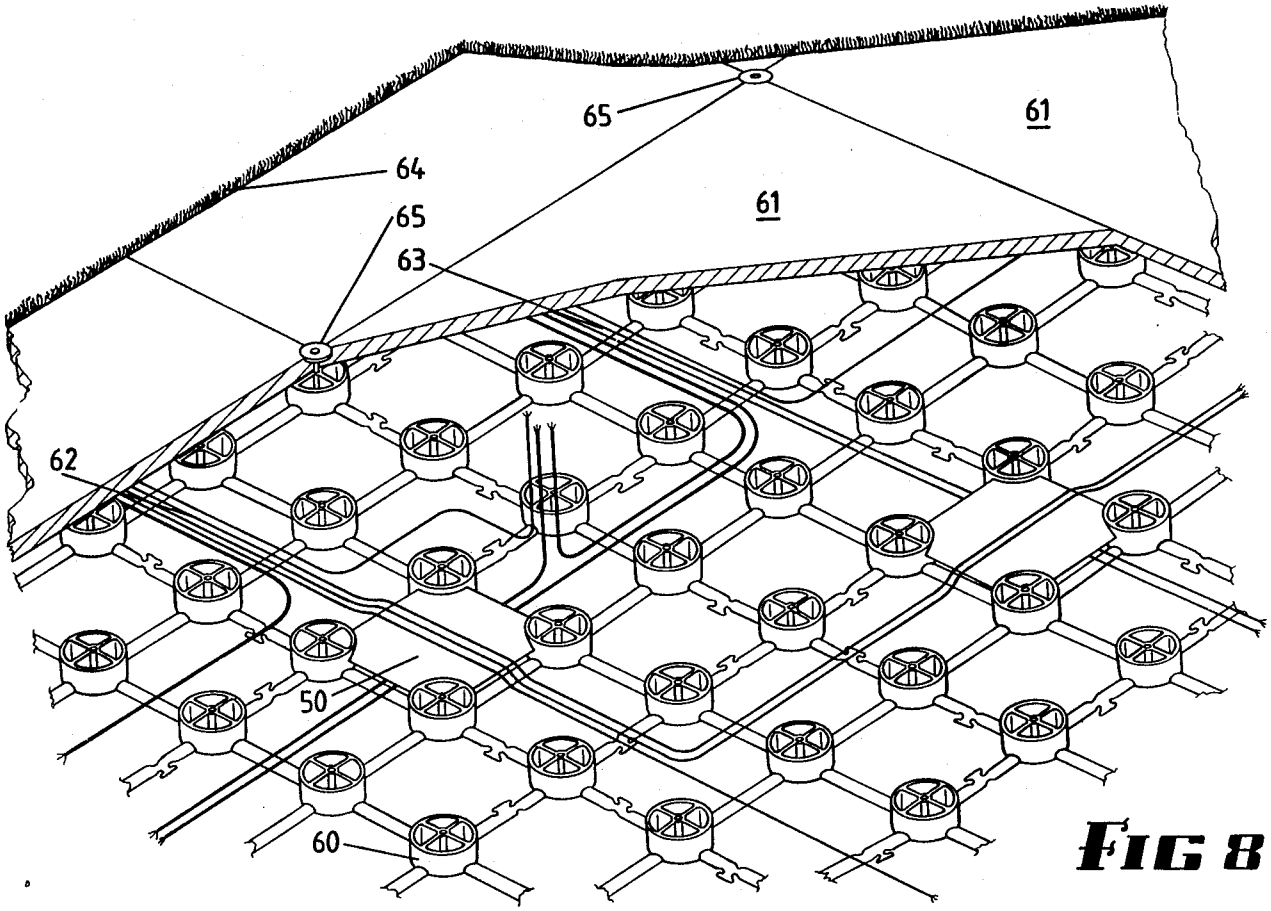
FIG. 8 shows a general layout of a false floor using the false floor support modules according to this invention.

FIG. 8 shows an overall view of a false floor arrangement as provided by the false floor support modules of the present invention. The plurality of props 60 support floor panels 61 which are of greater area than just one of the floor support modules, and cables 62 and 63, for instance, can then be easily laid in any direction underneath the floor panels 61. Where cables cross, a cross-over plate or bridge may be used to provide an insulated cross-over point between the cables of different services. Carpet 64 or any other suitable floor covering may be placed over the panels 61 to provide a good finish for the false floor.

It will be noted that, to provide further services, it is only necessary to remove the corner clamps 65 and lift a floor panel 61 or a series of floor panels to install the new service, to tie the service down where necessary, to drill suitable apertures in the floor panel to extend the service to the work area and to replace the floor panel, or panels with the service passing through the aperture, and then to replace the corner clamps 65 to fasten down the panels.

The spacing of the floor panel in this figure to cover five props may, of course, be varied to cover three or four props, depending upon the floor loading, type of panel and amount of access which may be required.

Figure 9:
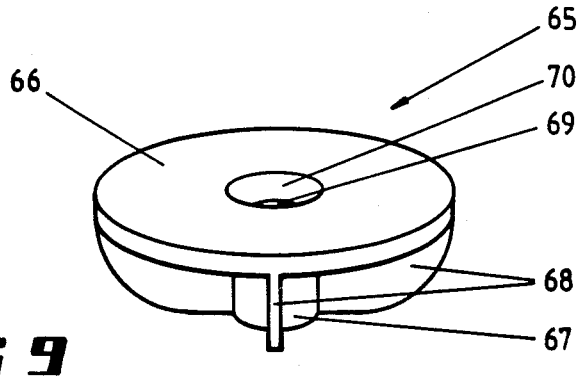
FIG. 9 shows a perspective view of a corner clamp.
Figure 10:
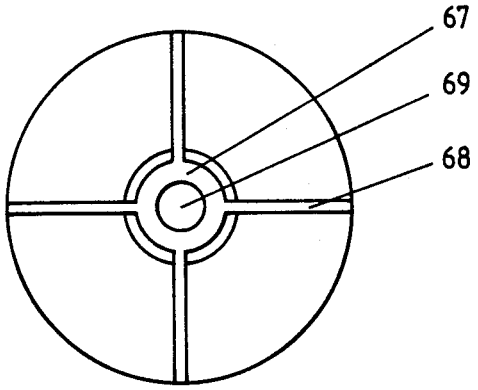
FIG. 10 shows an underneath view of a corner clamp.

FIG. 9 shows a side view of a corner clamp 65. The clamp includes an upper plate 66, which, in use is mounted flush with the floor panel surface, and a downwardly depending leg 67 supported by webs 68. The webs 68 also act as dividers between floor panels to prevent them from rubbing against each other when dynamic loads, foot or trolley traffic, are applied across the upper panel surfaces. This permanent panel separating device provided by the webs 68 is a feature of this invention. It enables easy initial and subsequent location of floor panels, plus it prevents squeaking between adjacent panels. A central aperture 69 is countersunk, at 70, to enable a screw-threaded fastener 71 to hold down the corners of four adjoining panels.

Figure 11:
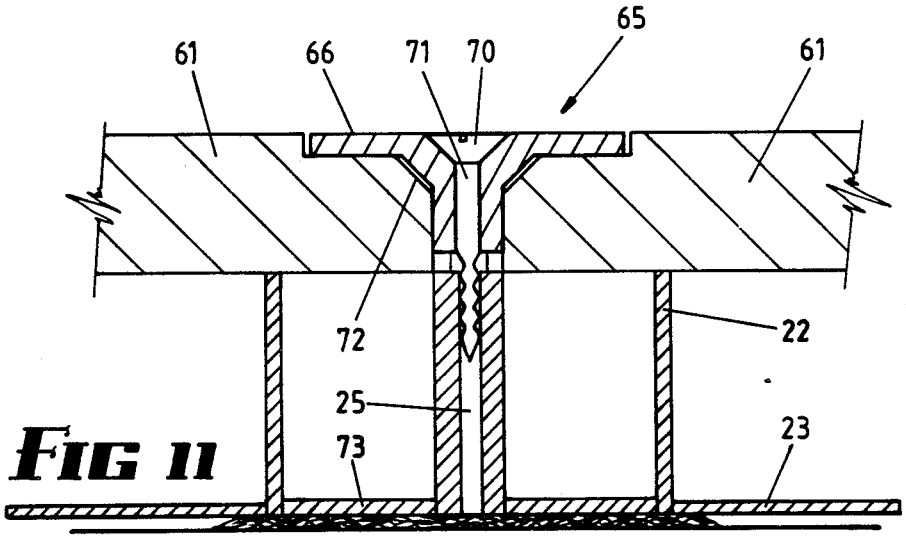
FIG. 11 shows a cross sectional view of a corner clamp installed between panels and into a support prop.

FIG. 11 shows a single prop 22 of a floor support module having a central aperture 25 into which the screw threaded fastener 71 is received. The floor panels 61 have a corner rebate 72 machined in them to receive the corner clamp 65.

In use, an adhesive bed 73 is placed under the bottom pad of the prop 22 and, when the panels 61 are placed on the floor support module and the fastener 71 screwed down, the thick adhesive bed 73 may be expanded or mostly expelled from under the prop, or alternatively contracted or minimally sucked upwards, thereby affecting its thickness before curing. This action of the adhesive during the clamping-down of four adjoining panels is a feature of this invention. It enables the finite leveling and rapid installation of the floor panels. It also results in an even and solid underfoot feel and presents a quality floor surface suitable for the installation of a carpet covering.

Although the various embodiments of this invention have been discussed using a square grid arrangement of props interconnected by a similar square frame arrangement, it will be realized that other shapes such as rectangular, triangular or hexagonal arrangements may all be used to create a plurality of props beneath removable access floor panels. Similarly, the number of props in an individual support module may be greater or lesser in number than the four discussed above. For instance, a square matrix arrangement of four by four or sixteen props with four interconnection pads extending from one side of the matrix and another four from an adjacent side creates a further embodiment of this invention. When interconnected to similar support modules, the same infinite grid arrangement of props is possible. Also, the interconnection means between support modules discussed above is only one example of the means available for rapidly interconnecting modules. Any suitable arrangement to enable quick positive interconnection of modules is appropriate to the present invention.

As discussed earlier, the false floor support module and corner clamp according to this invention are particularly adapted to be manufactured from injection moulding of plastics material or other suitable compound.

I claim:

1. A floor support module for a false floor support system, the floor support module being of unitary construction and comprising:

a plurality of support props standing on end and being of equal height, said support props being arranged perpendicular to and extending upwards from a common plane and being joined to one another by an integral frame arrangement;

connection means for interconnecting said support module to at least one adjacent like floor support module; and at least one corner clamp mountable by means of a screw threaded fastener to one of the support props, the corner clamp comprising a plate to hold four adjoining floor panels down onto said floor support module to provide a floor said plurality of support props comprising:

a central prop with three further props arranged, with grid spacing, in a first square grid arrangement, the props being interconnected by the integral frame arrangement, three prop interconnection pads, with the three prop interconnection pads and the central prop arranged in a second square grid arrangement having a grid spacing substantially the same as the grid spacing of the first square grid arrangement, the first square grid arrangement being on an opposite side of the central prop from the second square grid arrangement, the prop interconnection pads comprising the means to interconnect the module to adjacent like floor support modules and the three prop-interconnection pads being joined to each other and to the central prop by a integral frame arrangement similar to that of the first square grid arrangement.

2. A module for a false floor support system as in claim 1, wherein:

the plate on the corner clamp is designed to be rebated into the floor panels so that the top surface of a floor, once installed, is smooth, but with the corner clamp at the corners of the respective panels holding down the floor panels onto the floor support module;

the corner clamp also including a plurality of webs extending down from the underside of the plate which, in use, act as spacers between adjacent floor panels.

3. A module for a false floor support system as in claim 1, wherein:

each support prop comprises a cylindrical body with a plurality of radial webs extending from a central boss to the cylindrical body, the central boss including a axial aperture to receive the screw-threaded fastener.

4. A module for a false floor support system as in claim 1, wherein:

the connection means comprise a prop-interconnection pad including a planar plate and a plurality of engagement clips extending upwards from the planar plate, the clips being adapted to engage, in use, the central boss of a support prop of an adjacent like floor support module.

5. A module for a false floor support system as in claim 1, wherein:

the false floor support module is adapted to be adhered to a sub-floor to provide an overall rigid structure by means of each prop including a substantially planar lower surface to which adhesive may be applied.

6. A module for a false floor support system as in claim 1, further including:

attachment means on the frame arrangement to enable the positioning and retention of services, cabling and conduits.

7. A module for a false floor support system as in claim 1, wherein:

the attachment means comprises an extension from the frame attachment about which cable ties may be secured.

8. A module for a false floor support system as in claim 1, wherein:

the integral frame arrangement comprises rigid arms extending between bases of the adjacent props and prop-interconnection pads and the corner clamp is adapted to be received into any one of the props.

9. A false floor support system, comprising:

a plurality of horizontally-adjacent, like floor support modules, each being of unitary construction and each comprising:

a plurality of support props standing on end and being of equal height, said support props being arranged perpendicular to and extending upwards from a common plane and being joined to one another by an integral frame arrangement;

connection means for interconnecting each said support module to at least one said horizontally-adjacent, like floor support module;

at least one screw-threaded fastener;

at least one corner clamp mountable by means of said screw-threaded fastener to a respective at least one of said support props, each said corner clamp including a plate for holding a plurality of horizontally-adjoining floor panels down onto the respective floor support module to provide a floor;

said connection means connecting said support modules to one another in a horizontally-extending array;

a plurality of horizontally-adjoining floor panels having edges, respective twos of which edges meet at respective corners of each said floor panel;

said floor panels being arranged edge-to-edge and corner-to-corner, and supported upon said support props with said corners each being supported on a respective said one support prop;

said corner clamps being mounted to respective said one support props by said screw-threaded fasteners so as to clamp said corners of said floor panels down onto said floor support modules, thereby providing a floor spaced above said common plane;

each said at least one support prop comprising a tubular cylindrical body, a central boss spacedly surrounded by said tubular cylindrical body, and a plurality of vertically-extending radial webs connecting said central boss with said tubular cylindrical body;

each said screw-threaded fastener being threaded into a respective upwardly-opening axial aperture provided in a respective said central boss;

said connection means for each of at least certain ones of said modules comprising:

a prop-interconnection pad including a planar plate and a plurality of engagement clips extending upwards from said planar plate;

said engagement clips engaging respective central basses of respective support props of respective horizontally-adjacent, like floor support modules.

10. The false floor support system of claim 9, wherein:

each said floor panel includes means defining an upwardly-opening recess therein at each said corner thereof and being otherwise upwardly flat-surfaced; and said corner clamps being rebated into said recesses and being upwardly flat so as to provide with said floor panels a floor surface which is substantially flat.

11. The false floor support system of claim 10, wherein:

each said corner clamp includes a plurality of webs provided on an underside of the respective said plate so as to radiate away from one another;

said webs on each said corner clamp being received between respective said edges of respective said floor panels for slightly spacing respective said floor panels horizontally from one another by respective given amounts.

12. The false floor support system of claim 9, further including:

a sub-floor having an upper surface disposed approximately in said common plane;

each said planar plate including a substantially planar lower surface arranged substantially in said common plane; and adhesive means provided between said substantially planar lower surfaces of said planar plates and said upper surface of said sub-floor and thereby securing said modules onto said sub-floor.

13. The false floor support system of claim 9, further including:

attachment means provided on said frame arrangement of each said module for enabling securement of services, cabling and conduits to said false floor support system under said floor.

14. The false floor support system of claim 9, wherein:

said floor panels are rectangular.

15. The false floor support system of claim 9, wherein:

said interconnecting frame arrangement for each module comprises a plurality of rigid arms each extending between respectively adjacent twos of said props.

16. The false floor support system of claim 15, wherein:

said rigid arms have lower surfaces disposed substantially in said common plane; and said rigid arms being substantially thinner in a vertical direction than said props are tall, whereby voids remain vertically between said floor and said rigid arms for passage of services, cables and conduits under said floor and over said rigid arms.

17. A method for providing a false floor supported on a sub-floor having an upwardly-facing surface disposed approximately in a common plane, comprising:

providing a plurality of like floor support modules, each being of unitary construction and each comprising:

a plurality of support props standing on end and being of equal height, said support props being arranged perpendicular to and extending upwards from a common plane and being joined to one another by an integral frame arrangement, each said at least one support prop comprising a tubular cylindrical body, a central boss spacedly surrounded by said tubular cylindrical body, and a plurality of vertically-extending radial webs connecting said central boss with said tubular cylindrical body; and connection means for interconnecting each said support module to at least one horizontally-adjacent, like said floor support module, said connection means for each of at least certain ones of said modules comprising a prop-interconnection pad including a planar plate and a plurality of engagement clips extending upwards from said planar plate, each said planar plate including a substantially planar lower surface arranged substantially in said common plane;

providing, for each said module, at least one screw-threaded fastener;

providing, for each said module, at least one corner clamp mountable by means of said screw-threaded fastener to a respective at least one of said support props, each said corner clamp including a plate for holding a plurality of horizontally-adjoining floor panels down onto the respective floor support module to provide a floor, each said corner clamp including a plurality of webs provided on an underside of the respective said plate so as to radiate away from one another;

providing a plurality of floor panels having edges, respective twos of which meet at respective corners;

providing an adhesive for adhering said modules to said upwardly-facing surface of said sub-floor;

applying said adhesive between said upwardly-facing surface of said sub-floor and at least some of said planar lower surfaces of said planar plates of said prop-interconnection pads;

arranging said modules in a horizontally-extending array on said upwardly-facing surface of said sub-floor, with said applied adhesive sandwiched therebetween, so that said connecting means interconnect each said support module to at least one horizontally-adjacent, like said floor support module, so that said connection means connect all of said floor support modules to one another in said array, with said engagement clips of each said prop-interconnection pad engaging the central boss of a respective support prop of a respective horizontally-adjacent, like said floor support module;

placing said floor panels progressively row-by-row loosely in place upon said support props, with said floor panels arranged edge-to-edge and corner-to-corner, with each of said corners supported upon a respective said one support prop;

loosely fitting said corner clamps progressively row-by-row to respective said one support props by threading said screw-threaded fasteners through said corner clamps and loosely into respective said central bosses;

adjusting said floor panels progressively row-by-row so that said webs on each said corner clamp are received between respective said edges of respective said floor panels for slightly spacing respective said floor panels horizontally from one another by respective given amounts; and tightening said screw-threaded fasteners progressively row-by-row to provide said floor.

* * * * *